US005717429A

United States Patent [19]

Coulon et al.

[11] Patent Number: 5,717,429

[45] Date of Patent: Feb. 10, 1998

[54] LOW PROFILE, LIGHT WEIGHT KEYBOARD

[75] Inventors: Kenneth E. Coulon, Plano; Jeffrey E. Faris, Richardson, both of Tex.

[73] Assignee: Texas Instruments Incorporated, Dallas, Tex.

[21] Appl. No.: 627,258

[22] Filed: Apr. 3, 1996

[51] Int. Cl.[6] ..... H01H 3/12; H01H 13/70; B41J 5/12

[52] U.S. Cl. ..... 345/168; 200/5 A; 200/344; 200/513; 200/534; 400/472; 400/490

[58] Field of Search ..... 345/168; 200/344, 200/345, 5 A, 306, 513, 515, 534, 535; 400/490, 472

[56] References Cited

U.S. PATENT DOCUMENTS

| | | | |
|---|---|---|---|
| 4,127,758 | 11/1978 | Lowthorp | 200/513 |
| 4,378,478 | 3/1983 | Deeg | 200/515 |
| 4,716,262 | 12/1987 | Morse | 200/5 A |
| 4,814,561 | 3/1989 | Kawasaki | 200/517 |
| 5,212,356 | 5/1993 | English | 200/5 A |
| 5,215,187 | 6/1993 | Ping-Chieng et al. | 200/344 X |
| 5,220,521 | 6/1993 | Kikinis | 364/709.08 |
| 5,340,956 | 8/1994 | Chen | 200/341 |
| 5,358,344 | 10/1994 | Spence | 400/490 |
| 5,386,091 | 1/1995 | Clancy | 200/344 X |
| 5,389,757 | 2/1995 | Souliere | 200/345 |
| 5,595,449 | 1/1997 | Vitkin | 400/472 |

*Primary Examiner*—Raymond J. Bayerl
*Assistant Examiner*—Seth D. Vail
*Attorney, Agent, or Firm*—Bret J. Petersen; James Kesterson; Richard Donaldson

[57] ABSTRACT

Portable electronic devices, such as notebook computers, are provided with the capability of a low profile and light weight keyboard, allowing greater reduction in the size and weight of portable computers without compromising the functionality. In specific embodiments, the present invention provides laptops, notebooks, and sub-notebooks with a low profile keyboard having a polymer top surface. In an embodiment of the invention, a structural rib 214 surrounds at least some portion of the key to advantageously provide a firm offset of the key top from the circuit board 206 for increased key travel over prior art designs. In another embodiment of the present invention, the keyboard key includes alignment pistons 218 affixed to the flexible key layer 202 and extend into holes in the circuit board 206 to provide advantages such as keeping the key's top surface flat, preventing the key from tilting or collapsing on only one or two sides.

20 Claims, 2 Drawing Sheets

FIG. 5
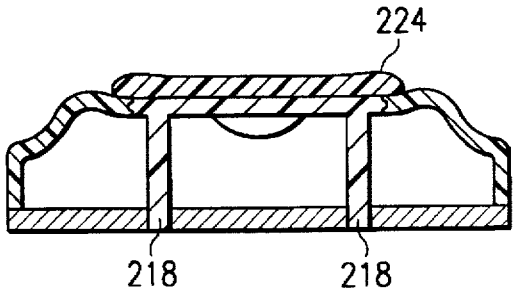
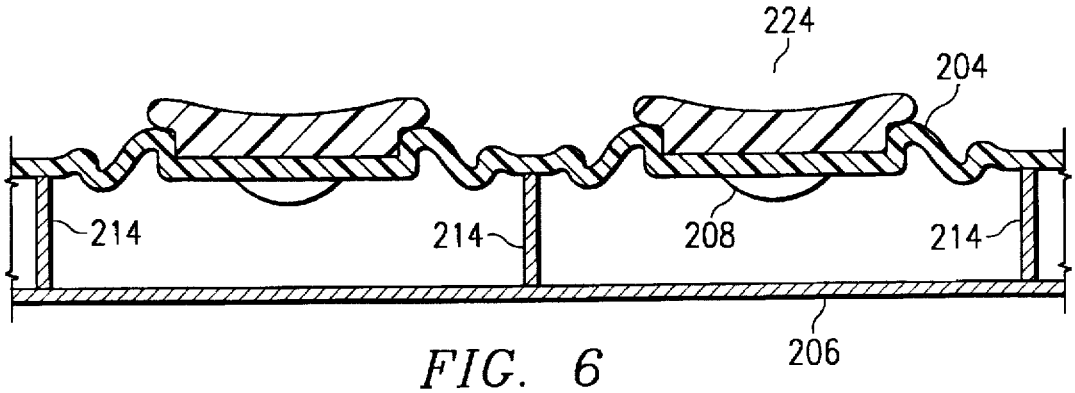
FIG. 6
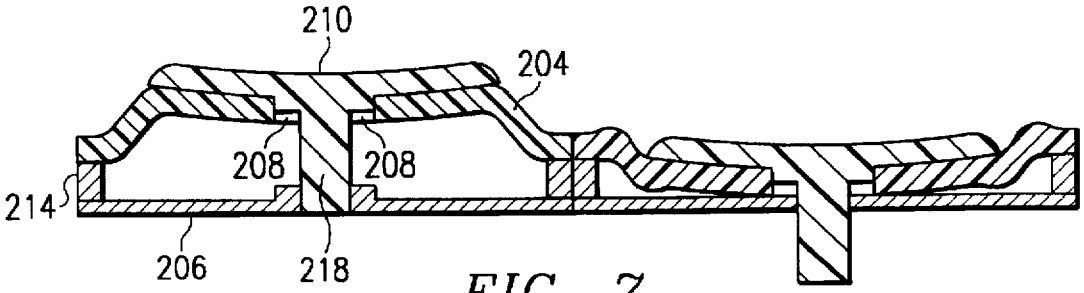
FIG. 7
FIG. 8
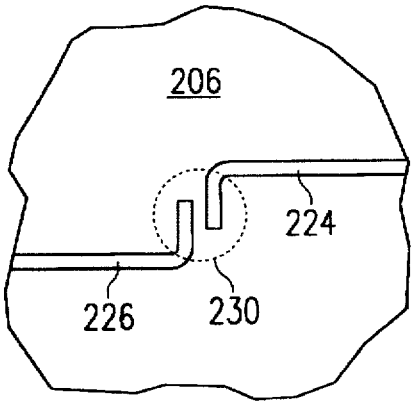

LOW PROFILE, LIGHT WEIGHT KEYBOARD

FIELD OF THE INVENTION

This invention relates to keyboards and keyswitches, and more particularly, to a low profile keyboard for use in portable computers such as laptops, notebooks, subnotebooks and pen computers, and other electronic machines that require keyboards.

BACKGROUND OF THE INVENTION

Keyboards or keyswitches are found on nearly every electronic device. Of particular interest herein are keyboards on portable electronic devices such as portable personal computers. Portable personal computers have developed from early luggable "suit case" designs, through the smaller "laptop" design, and now, with the aid of increasingly smaller packaging to "notebook," "sub-notebook," and personal digital assistants (PDAs) such as pen computers.

A "notebook" personal computer is about the size of a conventional loose leaf binder holding letter size paper, and typically weighs about 5–8 pounds. PDAs typically are too small to incorporate a keyboard and therefore often use a pen as the main interface for input. PDAs may weigh less than one pound to about 3 pounds with a screen size of about 5 by 7 inches or smaller. Those portable computers having size, weight, and performance lying between the notebook and PDA are typically referred to as subnotebooks. In many portable notebook computer models, a keyboard compartment is hinged to a display screen compartment in such a manner that it is possible to fold the display screen compartment down against the keyboard compartment and to latch the two together. PDAs typically are a single enclosure with a screen on the top surface.

A significant portion of the thickness and weight of notebook and subnotebook computers is the keyboard. Low profile switches are sought to reduce the height and weight of keyboards in portable personal computers. Additionally, a low profile, light weight keyboard could be used in virtually an unlimited variety of electronic devices appearing on the market attempting to satisfy an insatiable demand for small, portable devices.

U.S. Pat. No. 5,220,521 issued to Kikinis describes a keyboard which is molded from a flexible material and rollable into a cylinder for transport and storage. While this approach yields a low profile keyboard, it suffers from very little key travel and tactile feedback, so as not to be readily accepted by the average user.

SUMMARY OF THE INVENTION

This invention provides a low profile and light weight keyboard for portable electronic devices, such as notebook computers. In specific embodiments, the present invention provides laptops, notebooks, and sub-notebooks with keyboards which more closely approximate the feel and size of conventional keyboards in a lower profile and lighter package.

In one embodiment of the invention, a structural rib surrounds at least some portion of the key. The rib is rigid to advantageously provide a firm offset of the key top from the circuit board for increased key travel over prior art designs. The rib also acts to stiffen the assembly when bonded to the circuit board. A common rib may provide for support of adjacent keys and may be molded into the flexible key top and then affixed to the circuit board.

In another embodiment of the present invention, the keyboard key includes alignment pistons on multiple sides of the key. The alignment pistons are affixed to the flexible key layer and extend into holes in the circuit board. When the key is depressed, the alignment pistons slide through keyboard holes and extend past the circuit board. The alignment pistons provide advantages such as keeping the key's top surface flat, preventing the key from tilting or collapsing on only one or two sides. It is deskable for the key to collapse simultaneously on all four sides of the key to insure a clear, pleasing tactile feedback to the keyboard operator, in addition to providing a solid electrical contact.

An additional advantage of the present invention is the keyboard is a smaller keyboard to fit in the portable computer form factor but with the size and spacing of a larger or desktop keyboard.

Another advantage of the present invention is the keyboard keys have more travel for a better tactile feedback over prior art designs by using rigid ribs around the keys.

The present invention also advantageously combines flexible and rigid key portions which are integrally formed to provide a low cost, low profile keyboard with improved user feel and tactile feedback over prior art designs.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 5 Represents a top view of a key section having rigid and flexible materials integrally formed;

FIG. 6 Represents a cross-sectional side view of another embodiment;

FIG. 7 Represents a cross-sectional side view of another embodiment; and

FIG. 8 Represents a cutaway plan view of a keyboard circuit board section to show the keyboard conductive traces.

DETAILED DESCRIPTION OF THE PREFERRED EMBODIMENTS

The preferred embodiments of the present invention are best understood by referring to FIGS. 1–8 of the drawings, like numerals being used for like and corresponding parts of the various drawings.

Figure 1:
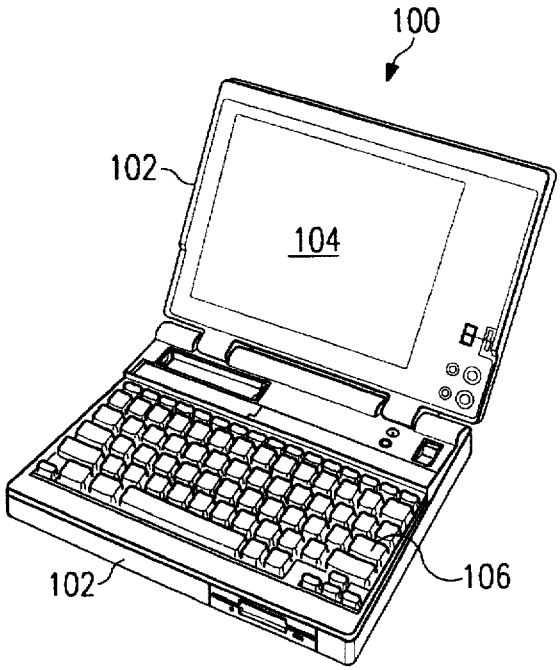
FIG. 1 (PRIOR ART)
FIG. 1 Represents a plan view of a typical notebook computer of the prior art.

With reference to FIG. 1, there is shown a prior art portable computer 100 of the type commonly referred to as a notebook computer, or laptop computer. Computer 100 includes a housing 102 which is a clamshell type enclosure which includes a top and bottom housing. The top housing typically includes a screen 104, and the bottom housing typically has a keyboard 106 above the computer's circuit board which contains a processor and other electronics such as memory storage. The two housings are connected along one edge with a hinge for pivotal movement relative to each other to expose the keyboard and display for use from the closed position. In order to reduce the overall thickness of the combined housings it is desirable to reduce the thickness of the keyboard and its associated housing.

Figure 2:
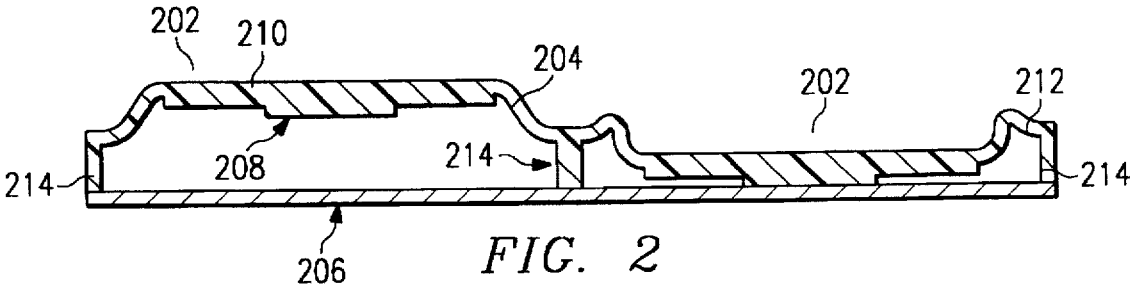
FIG. 2 Represents a cross-sectional view of two adjacent keyboard keys of a preferred embodiment of the present invention.

An embodiment of the present invention is illustrated in FIG. 2 which represents a cross section of two adjacent keyboard keys shown generally at 202. The keyboard is formed by a molded layer of flexible material, such as polyurethane 204 bonded to a circuit board 206. The flexible layer 204 has dome shaped pads for keys, and the circuit board 206 has electrically conductive traces forming circuitry for communicating keystrokes to a control circuit module located in the keyboard or in the computer mother board. There is a contact 208 on the lower surface of finger pad 210 which forms a contact closure element for selectively providing electrical closure between traces on the circuit board 206 when a user presses the finger pad 210. Contact closure causes a signal to be transmitted to a control circuit module to be coded for transmission to the computer's processor. The regions of conductive material that form contact 208 can be formed in a number of different ways. In the embodiment described here, these conductive regions may be provided by a conductive, rubber-based coating applied in a conventional manner, such as by silkscreening, and other masking techniques.

The key cell is based on a dome shaped finger pad 210 molded into the flexible layer 204, which provides for necessary vertical movement to accomplish a contact closure for a keystroke and to prevent closure otherwise. A depressed key 202 is shown at the right hand side of FIG. 2. The sides of the dome 212 collapse to bring the contact 208 in contact with circuit board trace. The amount of key travel, the vertical displacement from the unpressed key to the fully depressed key, is an important aspect of a keyboard from the standpoint of the user, providing tactile feedback and feel.

Figure 3:
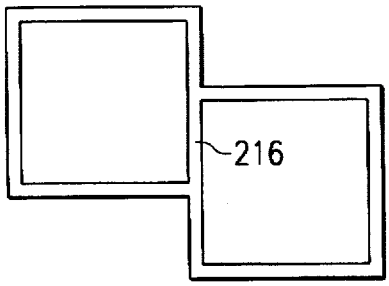
FIG. 3 Represents a top view of the key ribs for two adjacent keys of a preferred embodiment of the present invention.

An important aspect of the present invention is a structural rib 214 around at least some portion of the key. In contrast to the flexible layer 204 of the key, the rib 214 is rigid to provide a firm offset of the key top from the circuit board for increased key travel over prior art designs. The rib also acts to stiffen the assembly when bonded to the circuit board 206. FIG. 3 illustrates a top view of the rib for two adjacent keys of an embodiment having a structural rib on each side of the key. A common rib 216 in the form of a honey-comb structure may provide for support of adjacent keys as shown in FIG. 3. The ribs provide stiffness and rigidity to the entire circuit board as well as to the individual key cell to limit deflection of the circuit board. In this manner the deflection of the circuit board with respect to each key is controlled by the ribs for that key, acting much like a drum head for the key dome. As a result, the deflection of the entire circuit board is less relevant, allowing for the possibility of lighter weight circuit boards and structures. The rib may be molded into the flexible key top and then affixed to the circuit board 206, formed as a honey-comb structures and bonded between the circuit board and the flexible dome layer, or formed as a part of the circuit board. Also, the circuit board may be a rigid material or a flexible material.

Figure 4:
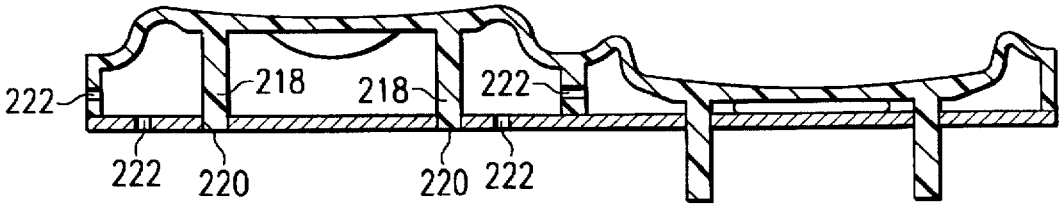
FIG. 4 Represents a cross-sectional view of two adjacent keyboard keys of a second preferred embodiment of the present invention.

A second embodiment of the present invention is illustrated in FIG. 4. This embodiment includes alignment pistons 218 on two sides of the key. The alignment pistons are affixed to the flexible key layer 204 and extend into the circuit board 206 in holes 220. When the key is depressed, as shown in the depressed key on the right portion of FIG. 4, the alignment pistons slide through keyboard holes 220 and extend as shown. The alignment pistons keep the key's top surface flat, preventing the key from tilting or collapsing on only one or two sides. It is desirable for the key to collapse simultaneously on all four sides of the key to insure a clear, pleasing tactile feedback to the keyboard operator, in addition to providing a solid electrical contact.

It may also be necessary or desirable to provide "breather" openings 222 through the ribs or the circuit board to allow air under the dome to escape when a keystroke is made. When a user presses down on the dome, the dome collapses, and when the pressure is removed, the dome returns to its original shape. That is, the "normal" position of the dome is in the uncollapsed condition. While the vents may be in the circuit board, ribs, or the dome to allow air to escape from the key cell when it is depressed, venting the circuit board rather than the dome is advantageous for keeping contaminants out of the key cell that could enter through the dome vents, and venting through the ribs may be more difficult or costly. The feel of a keystroke can also be varied by varying the number or size of the vents.

The molded dome shape may include a finger pad molded at the top of the dome. The finger pad may have a concave upper surface with letter or character symbols, such as the letter "A", applied to the upper surface. The letters or characters may be silkscreened, printed, or applied by a number of other techniques known in the art. The letters and characters may alternatively be molded into the surface as depressions below the level of the finger pad surface or with a two shot mold, so repeated use is less likely to wear the letters and characters away.

In addition, the key dome may be molded of two or more different polymer materials to match the material properties to the required mechanical characteristics of the various parts of the key dome, flexible in one area and rigid in another, etc. For example, in one embodiment shown in FIG. 5 the key dome has a rigid key cap 224 to form the key finger pad as discussed above. The rigid key cap may be formed as described in U.S. Pat. No. 5,340,956, Key Switch, issued to Castle Chen. The pistons 218 are also preferably formed of rigid material and may also be integrally formed with the key cap 224 and of the same material or a different material.

A third embodiment is illustrated in FIG. 6. In this embodiment, circuit board 206 is preferably a flexible printed circuit bonded to a honey-comb rib structure 214. A flexible layer 204 is bonded to the rib structure to form the key domes. Contacts 208 are on the underside of the domes for making contact with the circuit board. Key caps 224 may be formed of a rigid material and bonded or integrally formed with the flexible layer 204. This embodiment could also include alignment pistons as discussed above.

A fourth embodiment is illustrated in FIG. 7. In this embodiment includes a single alignment piston 218 at the center of the key. The circuit board 206 is preferably a printed circuit bonded to a honey-comb rib structure 214. A flexible layer 204 is bonded to the rib structure to form the key domes. Contacts 208 are on the underside of the domes for making contact with the circuit board. Key caps 224 may be formed of a rigid material and bonded or integrally formed with the alignment piston the flexible layer 204. In this embodiment the key contact 208 is formed in an area around the alignment piston and makes contact with electrical traces on the circuit board 206 in a raised area. The making of the contact is illustrated in the right half of FIG. 7 which shows a key in the depressed position.

The circuit board 206, as described briefly above, has electrically conductive traces for signalling keystrokes to the computer processor, for example by encoding the signals which are then transmitted to the computer. FIG. 8 is a cutaway plan view of the circuit board 206 in the area of a key cell of FIG. 2. Circuit board 206 has electrical traces 226 which do not intersect. Circle 230 indicates the area which lies under contact 208 shown in FIGS. 2 and 4. When the key is depressed, the sides of the dome 212 collapse to bring the contact 208 in contact with circuit board traces 226. The contact 208 is conductive and when in contact with two or more conductive traces effectuates making of the switch. The traces could be formed by coating the entire surface with conductive material, then removing material to shape the traces. The conductive material of the contact 208 could be molded into the flexible material, or otherwise attached to the key dome. The circuit board may be a rigid material or a flexible material. If the circuit board is a flexible material, perhaps for weight reduction, then the rigid ribs of the key cell act to limit deflection of the circuit board, acting much like a drum head.

It will be apparent to one skilled in the art that there are many variations that could be used for the sidewalls of the dome for an individual key cell. Wall thickness and angle can be varied, for example, to vary the force required to perform a keystroke, which affects the "feel" of the key to a user. Similarly, the key cell can be designed with different distances between the contact 208 and the circuit board.

What is claimed is:

1. A portable computing device comprising:

a. a housing having a computer processor;

b. a low profile keyboard associated with said housing comprising:

i) a circuit board having electrical traces;

ii) a flexible layer having dome regions for keys;

iii) a contact material affixed to a portion of said dome region for contacting said electrical traces on said circuit board; and iv) at least one rigid rib attached to the flexible layer and extending from the flexible layer to said circuit board, wherein said flexible layer allows the dome region to collapse to bring said contact material in contact with said circuit board.

2. The portable computer of claim 1, wherein said keyboard rigid rib extends peripherally around each key and is bonded around a substantial portion of the periphery to said key dome.

3. The portable computer of claim 1, wherein said keyboard further comprises at least one alignment piston connected to said flexible layer extending down into said circuit board.

4. The portable computer of claim 1, wherein said keyboard further comprises vent holes in said circuit board.

5. The portable computer of claim 1, wherein said keyboard keys further comprise a rigid key cap integrally formed with said flexible layer to form said dome.

6. The portable computer of claim 5, wherein said alignment pistons are of a rigid material integrally formed with said keyboard key caps.

7. A low profile keyboard for an electronic device comprising:

a. a circuit board having electrical traces;

b. a flexible layer having dome regions for keys;

c. a contact material affixed to a portion of said dome region for contacting said electrical traces on said circuit board; and d. at least one rigid rib attached to the flexible layer and extending from the flexible layer to said circuit board, wherein said flexible layer allows the dome region to collapse to bring said contact material in contact with said circuit board and then return to its original shape when released by the user.

8. The portable computer of claim 7, wherein said keyboard rigid rib extends peripherally around each key and is bonded around a substantial portion of the periphery to said key dome.

9. The keyboard of claim 7, wherein said keyboard further comprises at least one alignment piston connected to said flexible layer extending down into said circuit board.

10. The keyboard of claim 7, wherein said keyboard further comprises vent holes in said circuit board.

11. The keyboard of claim 7, wherein said keyboard keys further comprise a rigid key cap integrally formed with said flexible layer to form said dome.

12. The keyboard of claim 11, wherein said alignment pistons are of a rigid material integrally formed with said keyboard key caps.

13. A low profile keyboard for an electronic device comprising:

a. a flexible circuit board having electrical traces;

b. a flexible layer having dome regions for keys;

c. a contact material affixed to a portion of said dome region for contacting said electrical traces on said circuit board; and d. a honey-comb rib structure attached to the flexible layer and extending from the flexible layer to said circuit board, wherein said flexible layer allows the dome region to collapse to bring said contact material in contact with said circuit board.

14. The keyboard of claim 13, wherein said keyboard rigid rib extends peripherally around each key and is bonded around a substantial portion of the periphery to said key dome.

15. The keyboard of claim 14, wherein said keyboard further comprises at least one alignment piston connected to said flexible layer extending down into said circuit board.

16. The keyboard of claim 13, wherein said keyboard further comprises vent holes in said circuit board.

17. The keyboard of claim 13, wherein said keyboard keys further comprise a rigid key cap integrally formed with said flexible layer to form said dome.

18. The keyboard of claim 17, wherein said alignment pistons are of a rigid material integrally formed with said keyboard key caps.

19. A portable computing device comprising:

a. a housing having a computer processor;

b. a display associated with said computer processor for communicating with a user;

b. a low profile keyboard associated with said housing comprising:

i) a circuit board having electrical traces;

ii) a flexible layer having dome regions for keys;

iii) a contact material affixed to a portion of said dome region for contacting said electrical traces on said circuit board; and iv) at least one rigid rib attached to the flexible layer and extending from the flexible layer to said circuit board, wherein said flexible layer allows the dome region to collapse to bring said contact material in contact with said circuit board.

20. The portable computer of claim 19, wherein said keyboard further comprises at least one alignment piston connected to said flexible layer extending down into said circuit board.

* * * * *